US005421174A

United States Patent [19]

Kim et al.

[11] Patent Number: 5,421,174

[45] Date of Patent: Jun. 6, 1995

[54] WASHING MACHINE PULSATOR

[75] Inventors: Yong S. Kim, Kyungsangnam-do; Ji H. Lee, Pusan-city, both of Rep. of Korea

[73] Assignee: Goldstar Co., Ltd.

[21] Appl. No.: 164,936

[22] Filed: Dec. 10, 1993

[30] Foreign Application Priority Data

Feb. 26, 1993 [KR] Rep. of Korea ..... 1993-2761
Apr. 30, 1993 [KR] Rep. of Korea ..... 1993-7109
May 25, 1993 [KR] Rep. of Korea ..... 1993-8925

[51] Int. Cl.[6] ..... D06F 39/02

[52] U.S. Cl. ..... 68/17 A; 68/17 R; 68/134

[58] Field of Search ..... 68/17 A, 23.6, 23.7, 68/132, 133, 134, 17 R

[56] References Cited

U.S. PATENT DOCUMENTS 2,172,620 9/1939 Molinare ..... 68/133
2,642,733 6/1953 McCormick et al. ..... 68/17 A X
2,896,437 7/1959 Wuck et al. ..... 68/133
4,062,205 12/1977 Morey et al. ..... 68/17 A X
5,211,689 5/1994 Kobayashi ..... 68/17 R

FOREIGN PATENT DOCUMENTS 1081041 6/1954 France ..... 68/134
1-242093 9/1989 Japan ..... 68/134
2-31796 2/1990 Japan ..... 68/17 A
2-92392 4/1990 Japan ..... 68/17 A
2220007 12/1989 United Kingdom ..... 68/17 A

*Primary Examiner*—Frankie L. Stinson
*Attorney, Agent, or Firm*—Morgan & Finnegan

[57] ABSTRACT

This invention relates to a pulsator of washing machine enhancing washing capability, having an active ceramic for enhancing the activeness of water, and a container for containing the active ceramic, the container detachably fixed on the pulsator and provided with a plurality of holes for contact of said active ceramic with water in a washing tub. The snarling of laundries at the center of washing machine is prevented and the washing capability of washing water is enhanced by the active ceramic.

21 Claims, 4 Drawing Sheets

WASHING MACHINE PULSATOR

FIELD OF THE INVENTION

This invention relates to washing machine pulsators, more particularly to washing machine pulsators containing active ceramic to enhance washing capability.

BACKGROUND OF THE INVENTION

As shown in FIG. 1, conventional washing machines have a driving motor 1, a belt 2 transmitting the rotating power of the motor 1, a clutch 3 transmitting the rotating power transmitted by the belt 2, a pulsator 4 rotated by the rotating power transmitted by the clutch 3, a drying tub 5 to put laundries and a washing tub 6 to fill washing therein respectively.

As the pulsator 4 has, as shown in FIG. 2, a cylindrical part 8 formed at the center thereof, holes 9 provided in the cylindrical part 8 for allowing water flow and jointing holes 10. A fixed cam 11 is fixed by inserting hooks 13 formed in the lower part of the outer cylinder of the fixed cam 11 into the jointing holes 10 of the pulsator 4 after inserting the fixed cam 11 into the cylindrical part 8. A moving cam 17 has an outer cylinder 16 inserted between the cylindrical part 8 and the fixed cam 11 and an inner cylinder 18 inserted between the outer cylinder 12 and the inner cylinder 14 of the fixed cam 11. And the cam curve formed on a cam cylinder 19 provided between the outer cylinder 16 and the inner cylinder 18 of the moving cam 17, abuts with the upper edge of the outer cylinder 12 of the fixed cam 11. To prevent the moving cam 17 from falling-off, the cam curve 20 formed on the inner cylinder 18 of the moving cam 17 is hooked by the hooks 15 formed on the inner cylinder 14 of the fixed cam 11. Catches 21 are formed on the upper edge of the moving cam 17.

And a cap 22 is fixed inside of the moving cam 17 by hooks formed at the lower edge of the cap 22 inserted into the holes of the moving cam 17.

In the conventional washing machines of above described construction, washing is performed by the pulsator 4 continuously performing the movements of anticlockwise rotation—stop—clockwise rotation, driven by the driving motor 1 through the belt 2 and the clutch 3 after filling washing water in the washing tub 6 and putting laundries in the drying tub 5.

The revolutions of the pulsator 4 is, though it depends on laundries, generally below 300 rpm.

The pulsator 4 described above pushes out the incoming water and laundries gathering to the center of pulsator 4 toward the circumference thereof.

Due to the catches 21 formed on the upper edge of the moving cam 17 catch the pushed out laundries, the moving cam 17 rotates in the opposite direction of the rotation of the pulsator 4. Water flow pushing up through the water holes 9 provided in the cylindrical part 8 helps the moving cam 17 rotate smoothly between the cylindrical part 8 and the fixed cam 11.

And because of the abutting cam curve of the cam cylinder 19 of the moving cam 17 with the upper part of the outer cylinder 12 of the fixed cam 11, the moving cam takes rotating and up and down movements as shown in FIG. 3.

In conventional washing machines as described above, there has been a certain limit in getting well cleaned laundries from the washing, if the washing water has low activity, even though the water was fresh and filtered, irrespective of the washing capability of the washing machine and the detergent used.

The dispersing effect of the pulsator for the laundries gathering to the center has not been enough because the ratio of the diameter d2 of the moving cam 11 compared with that of the pulsator 4 has been about 20% and the angle between the upper vanes **4*a*** has been large.

And it has been hard to expect uniform washing effect due to the wind and roll of the laundries by the upper edge **4*b*** of the vanes during pulsation.

And there has been the possibility of leakage of water into clutch 3 through water holes 9 formed on the cylindrical part 8.

SUMMARY OF THE INVENTION

The object of this invention is to provide a pulsator of a washing machine capable of increasing washing effect while reducing the consumption of washing water and detergent.

Another object of this invention is to provide a pulsator of a washing machine which can prevent the snarling of laundries at the center of washing machine.

These and other objects are achieved by providing active ceramic in the pulsator of a washing machine to enhance the washing capability of washing water by the active ceramic.

Preferably, the pulsator of a washing machine of this invention provides a cam which can move an active ceramic chamber containing active ceramic therein in an up and down direction whereby the up and down movement help the active ceramic contact with washing water to enhance the washing capability of washing water.

And alternatively provided on the upper side of the pulsator of a washing machine of this invention, are the first upper vanes having long and large section and the second upper vanes having curved surface throughout and short and small section.

DETAILED DESCRIPTION OF THE INVENTION

Figure 1:
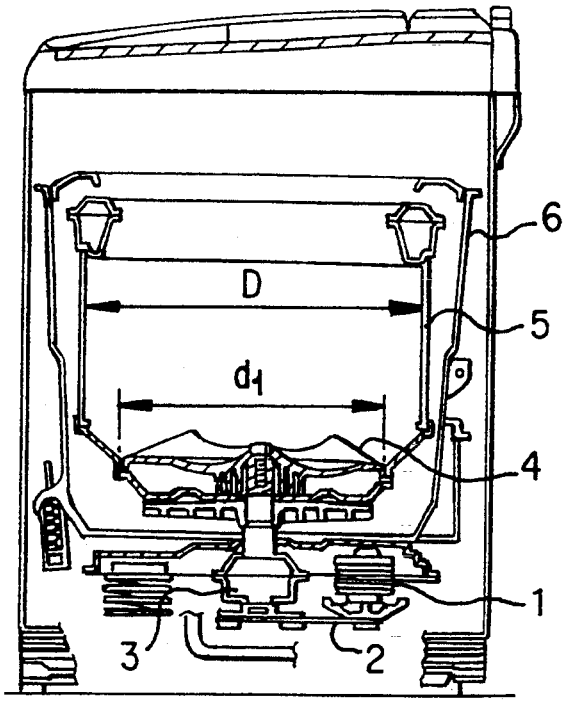
FIG. 1 is a sectional drawing of a conventional washing machine.
Figure 2:
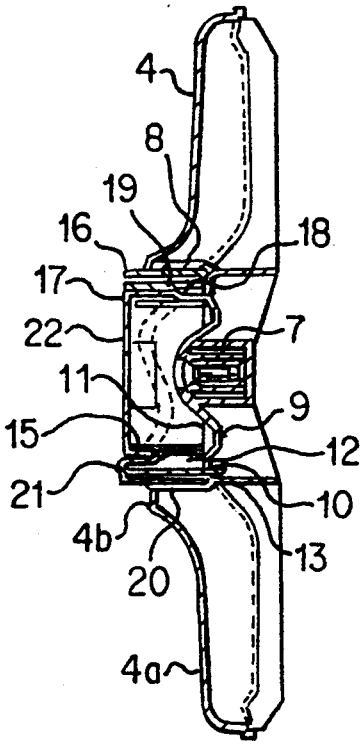
FIG. 2 is a sectional drawing of a pulsator of a conventional washing machine.
Figure 3:
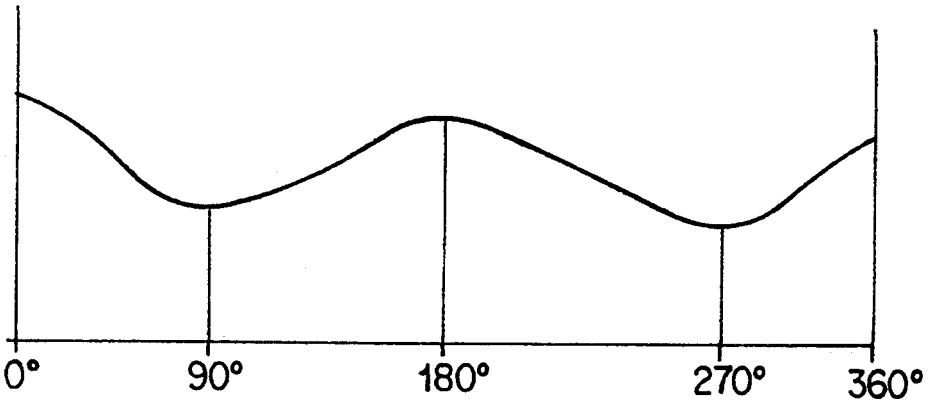
FIG. 3 shows a development of the moving path of a moving cam of the conventional washing machine.
Figure 4:
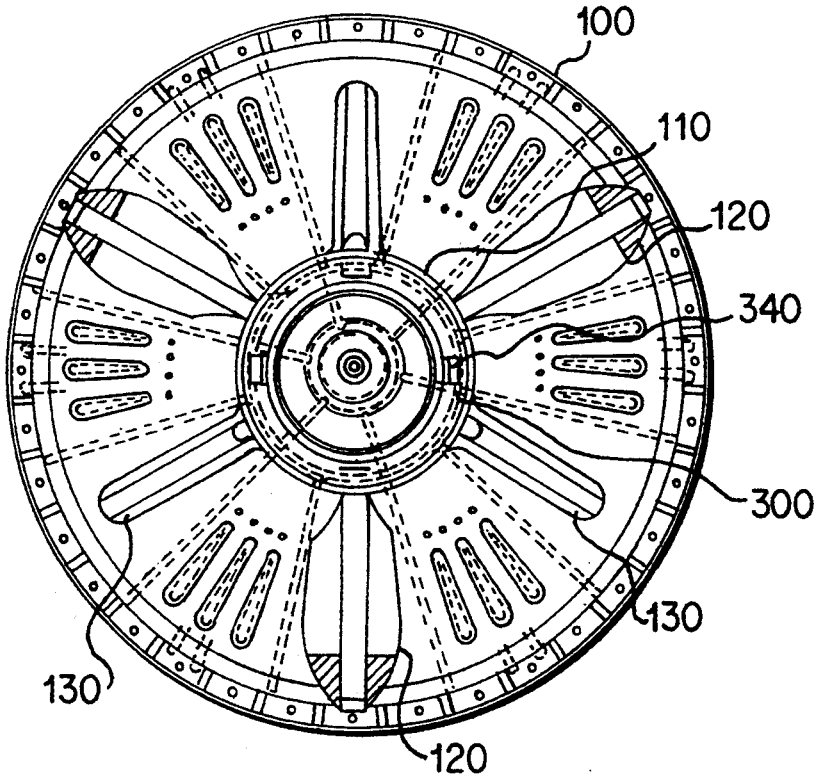
FIG. 4 is a plan view of a pulsator of a washing machine of this invention.
Figure 5:
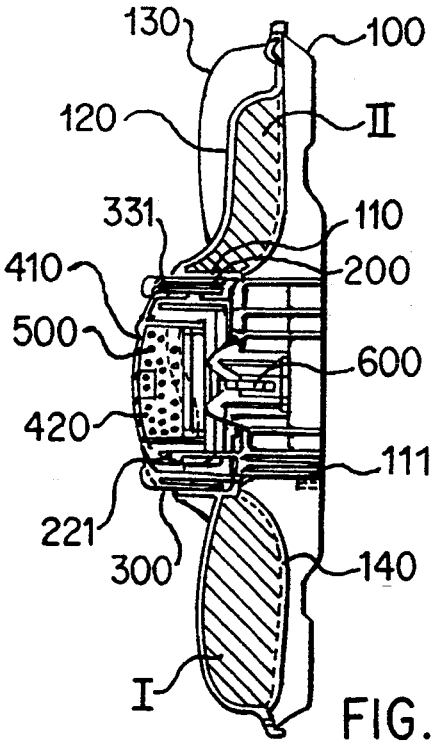
FIG. 5 is a sectional drawing of a pulsator of the washing machine of this invention.
Figure 6:
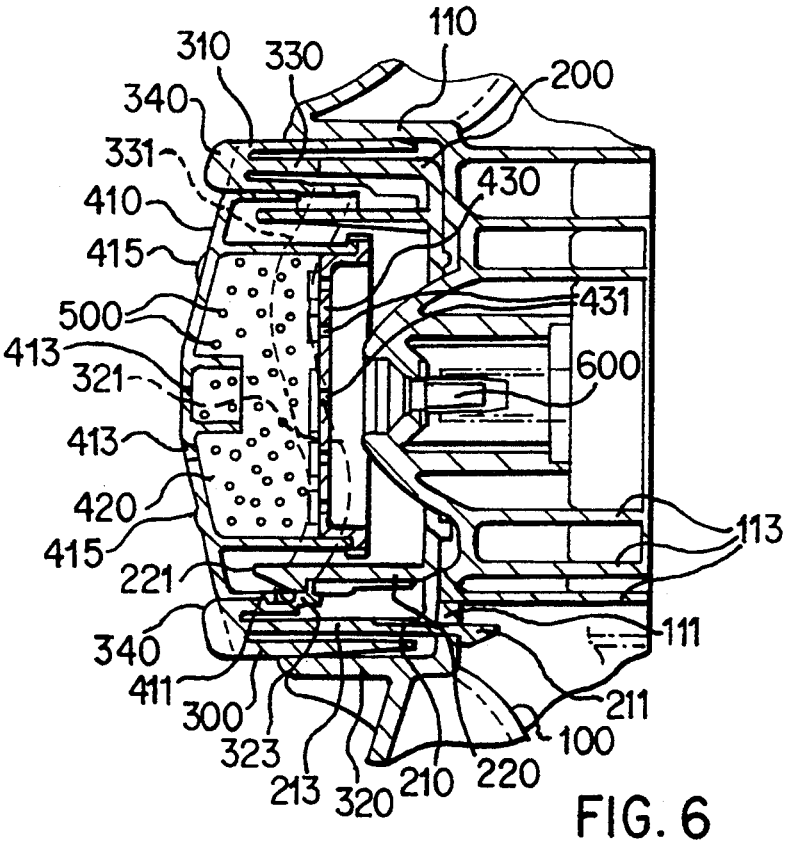
FIG. 6 shows enlargement of part A of FIG. 4.
Figure 7:
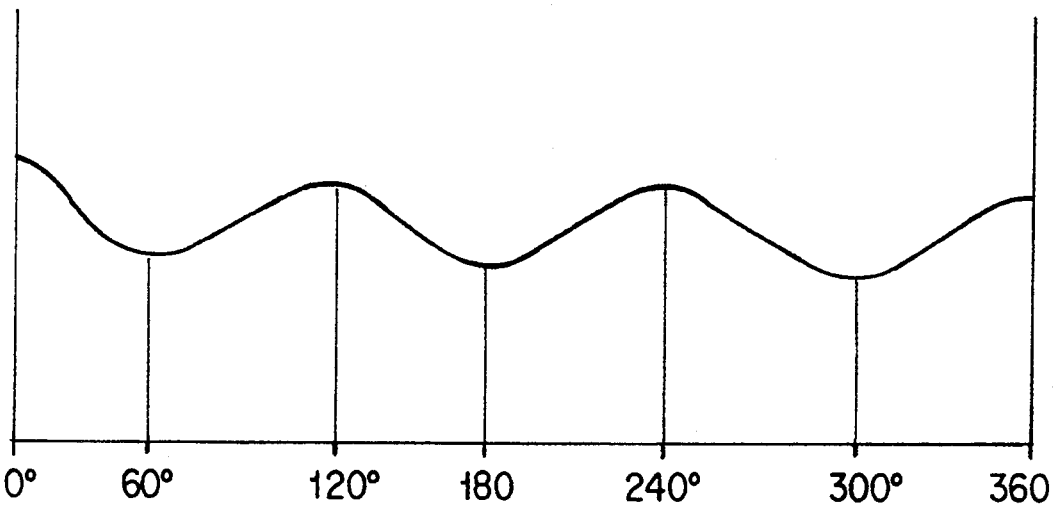
FIG. 7 shows a development of the moving path of a moving cam of the washing machine of this invention.

Shown in FIG. 4 to FIG. 6 is a pulsator of a washing machine of this invention.

The pulsator 100 includes a cylindrical part 110 protruded from the center of upper side thereof and the cylindrical part 110 has holes 111 formed in the lower part of the outmost part thereof and cylindrical ribs 113 downwardly provided in inner side of above holes 111.

A fixed cam 200 having an outer cylinder 210 formed outer side thereof and an inner cylinder 320 formed inner side thereof, is inserted in the cylindrical part 110.

The outer cylinder 210 includes hooks 211 formed at the lower part thereof to insert into the holes 111 of the cylindrical part 110 for securing the fixed cam 200 on the pulsator 100 and three or more cam projections 213 formed on the circumference above the hooks 211.

The inner cylinder 220 has catches 221 formed upper part thereof.

And the outer cylinder 210 and the inner cylinder 220 of the fixed cam 200 are formed in a single body integrally.

A moving cam 300 includes an outer cylinder 310 inserted between inside of the cylinder 110 and outside of outer cylinder 210, a cam cylinder 330 abutting with the upper edge of the outer cylinder 210 of the fixed cam 200 and an inner cylinder 320 inserted between the outer cylinder 210 and the inner cylinder of the fixed cam 200.

The cam cylinder 330 is provided with a cam curve 331 engaged with the upper edge of the outer cylinder 210 of the fixed cam 200 and the cam curve is composed of curves having more than two upper dead points and two lower dead points.

The inner cylinder 320 has a cam curve 321 which is caught by the catches 221 of the inner cylinder 220 of the fixed cam 200.

The cam curve 321 is composed of curves corresponding to the cam curve 331 of the cam cylinder 330.

And the inner cylinder 320 has holes 323 formed in higher part than the cam curve 321.

And the moving cam 300 has a plurality of catches 340 projecting higher than the upper edge of the cylindrical part 110 of the pulsator 100 formed on the upper edge of the integrated part of the upper parts of the outer cylinder 310, cam cylinder 330 and inner cylinder 320 of the moving cam 300.

A cap 410 inserted into the inner cylinder 320 of the moving cam 300, has hooks 411 inserted into holes 323.

A fall-off prevention cap 430 positioned in lower part of the cap 410 forms a containment chamber 420 in association with above cap 410.

The cap 410 and the fall-off prevention cap 430 has holes 413, 431 to the containment chamber 420.

An active ceramic 500 is contained in the containment chamber 420.

And the cap 410 is provided with convex lenses 410 in order to check the activeness of the active ceramic 500.

As shown in FIG. 5, the pulsator 100 has a bottom plate 140 formed to have an outward down slope from the cylindrical part 110 protruded from the center and a substantially flat and a little elevated planar part.

The pulsator 100 includes, as shown in FIG. 4 and FIG. 5, the first upper side vanes 120 having a long and large longitudinal section I and the second upper side vanes 130 having shorter and smaller longitudinal section II than that of the first upper side vanes 120 radially formed on the bottom plate 140.

As shown in FIG. 4, the first upper side vanes 120 and the second upper side vanes 130 are arranged alternatively along the direction of the rotation of the pulsator 100.

The effect of the embodiment of this invention described above is explained hereinafter.

After filling washing water in a washing tub and putting laundries in a drying tub, a driving motor is operated to rotate pulsator 100 through a clutch.

The pulsator 100 then carry out washing by continuous pulsation.

The revolutions of the pulsator 100 is, though it depends on laundries, generally below 200 rpm.

The first upper side vanes 120 having long and large longitudinal section I and the second upper side vanes 130 having short and small longitudinal section II arranged alternatively on the pulsator 100 produce water current slow but large resulting in the slow movement of laundries.

The moving cam 300 caught on the catches 340 by laundries gathering (tends to snarl) to the center on the pulsation of the pulsator 100, the cam curve 331 of the cam cylinder 330 moving along the upper edge of the outer cylinder 310 of the fixed cam 106, takes rotating and up and down movements.

The movements of the moving cam 300 taking up and down movements while rotating in opposite direction to the rotation of the pulsator 100 during the short pulsating cycle of the pulsator 100 caused by the moving path of the cam cylinder 340 of the moving cam 300 having three upper dead points and three lower points disperse the forces of thelaundries and water current to gather to the center of the pulsator 100.

Also the up and down and the rotating movements of the moving cam 300 help washing water contact with the active ceramic 500 contained in the containment chamber 420 through the holes 413, 431 formed on the cap 410 and the fall-off prevention cap 430. Consequently, the total surface of the washing water increases to become a water easy to penetrate deep into laundries and the water softens the surfaces of laundries due to the OH-ion produced through the contact of washing water with the active ceramic.

Accordingly, washing effect can be increased with reduced consumption of washing water and detergent.

And the alternative arrangement of the upper part vanes having two different sections smoothens the snatching effect of the vanes to the laundries whereby reduce the possibility of damage of the laundries.

The air layer formed in the cylindrical ribs 113 during the pulsation of the pulsator 100 prevents the washing water leaking into the ribs 113.

The washing water leakage into the clutch 3 is also prevented by providing the holes 111 in the outer circumference than the cylindrical ribs 113. The upward water current produced by the pushing out force caused by the pressure difference between inside and outside of the cylindrical ribs 113, help the smooth operation of the moving cam 300 and thereby help enhancing the activity of the active ceramic.

In accordance with the embodiment of this invention described above, it is possible to improve washing capability (cleaning ratio), flow of laundries and reduction of snarl of laundries compared with a conventional washing machine, as shown on the table below.

TABLE

| | Conventional | Embodiment |
|---|---|---|
| Cleaning ratio | 0.753 | 0.896 |
| Flow of laundry | 7 times/min | 8.34 times/min |
| Reduction of snarl | 32% | 22.7% |

Figure 8:
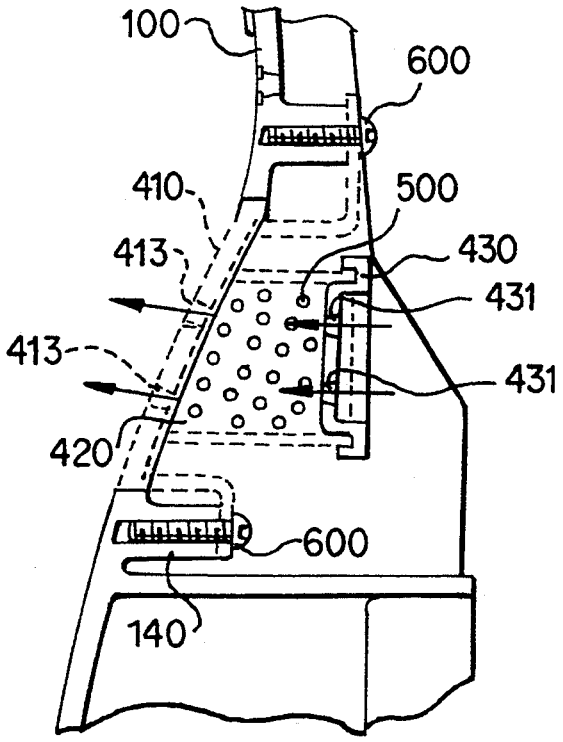
FIG. 8 shows another embodiment of a pulsator of the washing machine of this invention.

Shown in FIG. 8 is another embodiment of a pulsator of a washing machine of this invention, wherein the active ceramic 500 is provided in the outer circumference of the pulsator 100.

A cap 410 is fixed on a boss 140 in the outer circumference of the pulsator 100 by screws 600 and a fall-off prevention cap 430 is provided in the lower side of the cap 410 thereby forming a containment chamber 420 containing the active ceramic 500.

The cap 410 and the fall-off prevention cap 430 have holes 410, 431 in communication with the containment chamber 420.

In above arrangement, the contact of the active ceramic 500 with washing water is more active due to the stronger current of washing water in outer circumference of the pulsator 100 when the pulsator rotates.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

What is claimed is:

1. A pulsator of a washing machine, comprising: an active ceramic for decreasing the amount of hydroxide ions in the water used in the washing machine and thereby reduce the amount of needed detergent; and means for connecting said active ceramic to the pulsator; whereby said active ceramic is movable with the pulsator to facilitate contact between said active ceramic and the water.

2. A pulsator of a washing machine, comprising: an active ceramic for decreasing the amount of hydroxide ions in the water used in the washing machine and thereby reduce the amount of needed detergent; and containing means for releasably connecting said active ceramic to the pulsator; said containing means being provided with a plurality of holes for contact of said active ceramic with water in the washing machine; whereby said active ceramic is movable with the pulsator to facilitate contact between said active ceramic and the water.

3. A pulsator as claimed in claim 2, wherein said containing mean as includes a cap having said plurality of holes, a fall-off prevention cap forming a space for containing said active ceramic together with said cap, and means for securing said containing means on the pulsator.

4. A pulsator as claimed in claim 3, wherein said containing means is positioned at the center of the upper side of the washing machine pulsator.

5. A pulsator as claimed in claim 3, wherein said containing means is positioned in the outer circumference of the washing machine pulsator.

6. A pulsator of a washing machine, comprising:

an active ceramic for decreasing the amount of hydroxide ions in the water used in the washing machine and thereby reduce the amount of needed detergent;

means for releasably containing said active ceramic; said containing means being provided with a plurality of holes for contact of said active ceramic with water in the washing machine; and means interconnecting said containing means and said pulsator for rotating and making up and down movements of said containing means to facilitate contact between said active ceramic and the water while agitating the water in the machine.

7. A pulsator as claimed in claim 6, wherein said containing means is positioned at the center of the upper side of the pulsator.

8. A pulsator as claimed in claim 6, wherein said containing means includes a cap having said plurality of holes, a fall-off prevention cap forming a space for containing said active ceramic together with said cap, and means for securing said containing means on the pulsator.

9. A pulsator of a washing machine comprising:

an active ceramic for decreasing the amount of hydroxide ions in the water used in the washing machine and thereby reduce the amount of detergent needed;

means for containing said active ceramic and having a plurality of holes for facilitating contact of said active ceramic with water in the washing machine; and motion means connected to said containing means and positioned on the upper side of the center of the pulsator for rotating and making up and down movements of said containing means to facilitate contact between said active ceramic and the water;

said motion means including a fixed cam, and a moving cam having a cam curve engaging with the fixed cam to make said rotating and up and down movements along the fixed cam.

10. A pulsator as claimed in claim 9, wherein said cam curve of the moving cam composed of a curve having three upper dead points and three lower dead points.

11. The pulsator of claim 9 wherein said motion means is positioned in a cylindrical part protruding from the upper side of the center of the pulsator.

12. The pulsator of claim 11 wherein said motion means is positioned in said cylindrical part, and includes an inner cylinder, an outer cylinder, a cam cylinder and a plurality of catches projecting higher than the upper part of the cylindrical part.

13. A washing machine comprising:

a washing tube, a source of wash water for said tube, a power driven pulsator having a plurality of vanes in said tube for agitating water therein, an active ceramic for decreasing the amount of hydroxide ions in the wash water;

means detachably fixed on the pulsator for containing said active ceramic, said containing means including a plurality of holes for passage of the wash water therethrough and into said tube after contact with said active ceramic; and motion means for rotating and making up and down movements of said containing means to enhance contact of the wash water therein with said active ceramic and decrease the amount of hydroxide ions in the wash water being fed to said tube.

14. The washing machine of claim 13 wherein said containing means includes a cap having said plurality of holes, a fall-off prevention cap forming a space for accommodating said active ceramic together with said cap, and means for securing said containing means on the pulsator.

15. The washing machine of claim 13 wherein said containing means is positioned at the center of the upper side of pulsator.

16. The washing machine of claim 13 wherein said containing means is positioned in the outer circumference of said pulsator.

17. The washing machine of claim 16 wherein said motion means includes a fixed cam secured in the cylindrical part of the pulsator and a moving cam having a cam curve engaging with the fixed cam to make rotating and up and down movements along the fixed cam.

18. The washing machine of claim 17 wherein said motion means further comprises a plurality of catches projecting higher than the upper part of the cylindrical part, and wherein said containing means is fixed therein.

19. The washing machine of claim 17 wherein said cam curve of said moving cam has three upper dead points and three lower dead points.

20. The washing machine of claim 13 wherein said motion means is positioned in a cylindrical part protruding from the upper side of the center of the pulsator.

21. The washing machine of claim 13 wherein the decrease in the amount of hydroxide ions in the wash water reduces the amount of needed detergent.

* * * * *